United States Patent [19]

Salomon

[11] 3,964,759

[45] June 22, 1976

[54] SKI BINDING FOR SKI BOOT

[75] Inventor: Georges Pierre Joseph Salomon, Annecy, France

[73] Assignee: Establissements Francois Salomon et Fils, Annecy, France

[22] Filed: Mar. 7, 1975

[21] Appl. No.: 556,439

[30] Foreign Application Priority Data

Mar. 14, 1974 France ..... 74.08717

[52] U.S. Cl. ..... 280/626

[51] Int. Cl.[2] ..... A03C 9/08

[58] Field of Search ..... 280/11.35 T

[56] References Cited

UNITED STATES PATENTS

| | | | |
|---|---|---|---|
| 3,466,057 | 9/1969 | Dobler | 280/11.35 T |
| 3,797,843 | 3/1974 | Salomon | 280/11.35 T |
| 3,873,112 | 3/1975 | Covini | 280/11.35 T |
| 3,874,685 | 4/1975 | Besser | 280/11.35 T |

*Primary Examiner*—Robert R. Song

[57] ABSTRACT

The binding comprises two lateral arms; a retaining element; and a guidance system consisting of slopes and stops. The slopes are located on an element which is mobile in relation to the retaining element, in a manner such that, in certain positions of the mobile element, the guidance system is inoperative. The manual ski-removal lever is replaced with an element more easily manipulated by the skier, to enable him to remove the skis more rapidly. The device may also be adapted to certain variant bindings, so that they may open automatically in the absence of the boot.

10 Claims, 4 Drawing Figures

SKI BINDING FOR SKI BOOT

The present invention relates to a safety binding for ski boots, more particularly to bindings comprising a retaining element for one end of the boot, the element being arranged to pivot on links hinged in relation to the ski. The invention relates even more particularly to a binding comprising a system of slopes and stops located temporarily between the links and retaining element; the purpose of this guidance system is to prevent, momentarily, the retaining element from pivoting freely in relation to the links, especially as a result of an inadvertent blow on the end of the element.

Bindings of this kind have been described in U.S. application Ser. No. 541,131, filed on Jan. 15, 1975 by the Applicant, to which reference should be made for a knowledge, on the one hand, of the disadvantages of the structures known at that time, especially those described in Canadian Pat. No. 495,510 and, on the other hand, of the advantage of the system of slopes and stops recommended by Applicant. It is pointed out, however, at this time, that the structures described by the above-mentioned patent application, which will assist in the understanding of the present invention, will be described again briefly hereinafter in support of claims defining the scope of protection sought.

The majority of the bindings described in application Ser. No. 541,131 require a manual ski-removal lever which must be actuated by the skier in order to open the "binding" and release the boot. Furthermore, when the boot is released from the heelpiece without opening it, especially as a result of torsion causing the front stop to release, the skier must open the empty binding. It is particularly difficult to do this on a steep slope.

It is the purpose of this invention to overcome these disadvantages.

The invention proposes, to this end, to eliminate the manual ski-removal lever, or at least to replace it with an element which can be manipulated more conveniently by the skier, to enable him to remove his skis quickly.

The invention also covers a device which is adaptable to certain variants and is intended to open these bindings automatically in the absence of the boot.

The safety binding for ski boots according to the invention, designed to retain one end of the boot, more particularly the rear end, comprises two lateral arms or links; these arms run preferably on each side of the boot, each arm being pivotable in relation to the ski, at one end, about a first axis parallel with the plane of the ski.

The safety binding also comprises a retaining element which is mobile in relation to a second axis uniting the other ends of the lateral arms, the second axis being preferably parallel with the first axis. The retaining element comprises a jaw for holding the boot, the jaw being actuated by a resilient element.

The binding according to the invention also comprises a guidance system consisting of slopes and stops temporarily interposed between the elements in relative motion, namely: the links and the retaining element; in the case of inadvertent removal of the ski, this guidance system ensures that the elements in relative motion move against the action of the resilient element, and in a manner such that, in a system of axes connected to the links, the trajectory of the point of support of the jaw on the boot is at all times substantially the same. According to one essential characteristic of the invention, one of the two elements consistituting the guidance system (the slopes or the stops) is located on one moving element; the slopes of the guidance system are preferably located on the moving element, while the stops thereof are located on the links; this mobile element is hinged in relation to one of the elements in relative motion; more particularly, it is preferably mobile in rotation about an axis integral with the retaining element.

The mobile element moves between two positions:

- a first position for which the guidance system is in the operative position,
- a second position for which the guidance system is in the inoperative position, so that when the mobile element rocks into the second position, the skier may release the end of his boot from the binding and the binding opens of itself by its own weight.

When the ski is fitted, the mobile element is moved by the skier from the first to the second position, against the action of a resilient system, by an operating means; this operating means is preferably the retaining element itself, which the skier pushes backwards with his poles; moreover, in certain variants of the device, the resilient system opposing the rocking motion of the mobile element consists of the resilient element of the actual locking device of the binding, i.e. the device which actuates the retaining element.

According to another characteristic of the invention, the binding also comprises a lock which renders the mobile element momentarily mobile against the action of the resilient system; this lock, which is distinct from the lock which allows a safety release, is controlled by an element which is sensitive to the presence of the boot; in the absence of the boot, therefore, the resilient system has no substantial effect upon the mobile element. This device ensures that, in the absence of the boot, the binding opens of itself, which may be seen more clearly in the variants to be described hereinafter. The element sensitive to the presence of the boot preferably consists of a roller moving in a slot in the retaining element; moreover, the lock in this case consists of a slope located on the mobile element and bearing against the rear of the roller. The height of this slope is less than the length of the slot in which the axis of the roller slides; as a result of this, the roller advances, in the absence of the boot and leaves the slope in the mobile element, allowing the latter to rock freely towards the second position.

An additional spring, which moves the mobile element from the first to the second position, preferably assists in releasing the roller from the slope on the mobile element, in the absence of the boot.

A detailed description will now be given of a few examples of embodiment, which are by no means restrictive, in conjunction with the drawing, wherein.

Figure 1:
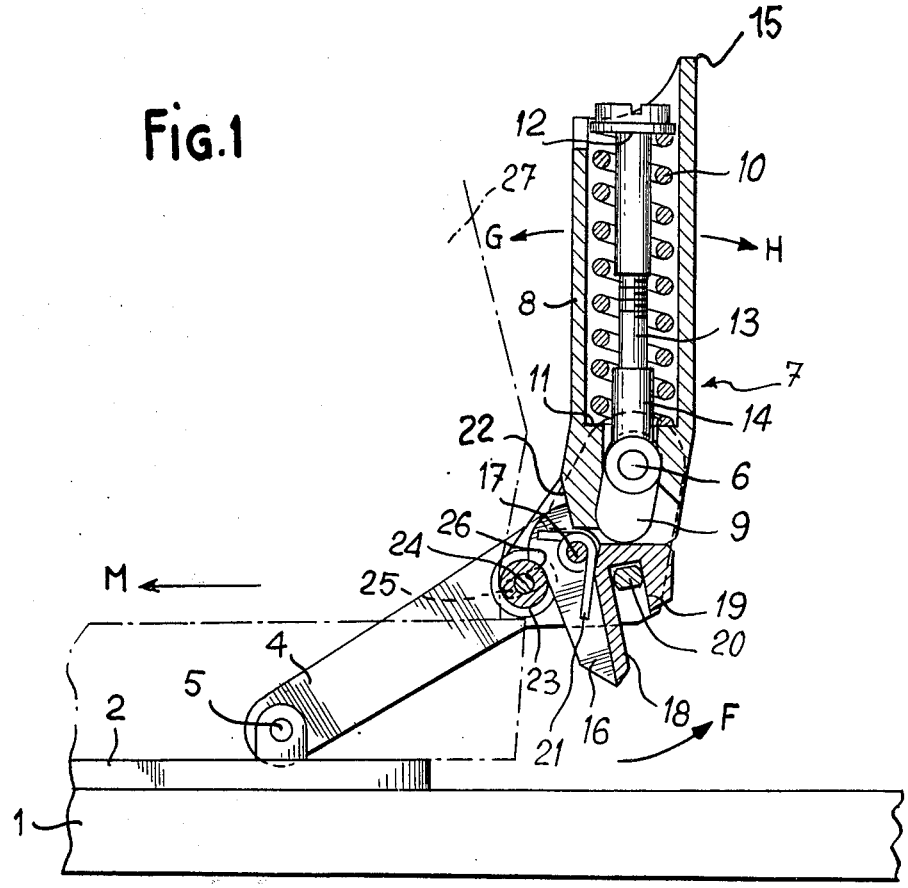
FIG. 1 is a longitudinal section, through the longitudinal plane of symmetry of the ski, of a heel-piece according to the invention, in the boot-fitted position.

A description will now be given of FIG. 1, which is a longitudinal section, through the longitudinal plane of symmetry of the ski, of a heel-piece according to the invention, in the boot-fitted position.

The heel-piece is secured to ski 1 by means of a baseplate 2. In certain examples of embodiment, this baseplate is secured to the ski by means of screws; in other examples, it is secured to the ski by means of screws; in other examples, it is mobile in rotation about a vertical pivot which itself is secured to the ski. Hinged to baseplate 2 are two lateral arms 4 running on each side of the skier's heel; the ends of these arms 4 are mobile in rotation about a pivot member 5 integral with baseplate 2 and parallel with the plane of the ski.

The rear ends of these arms are united by a pivot member 6 behind the skier's heel.

Heel-piece, or retaining element, 7 which is rotatable about pivot member 6. It comprises a hollow body 8, the lower part of which is provided with a slot 9. Pivot member 6 uniting the ends of the arms slides in this slot. Hollow body 8 contains a resilient element in the form of a coil spring 10, one end of which bears against a shoulder 11 located within the hollow body, while the other end bears against a washer 12 which is secured, by means of a bolt-and-nut system, to a longitudinal member 13 integral with a socket 14 which is rotatable about pivot member 6; the tension of spring 10 and thus the load required to produce a safety release may be adjusted by the skier by screwing-down or unscrewing washer 12.

The upper end of body 8 is equipped with a catch 15 to which the skier applies pressure with his pole or with the sole of his other boot, in order to cause the heel-piece to rock downwardly, as described hereinafter in greater detail.

The heel-piece also comprises a mobile element 16 hinged to a pivot member 17 integral with body 8. This mobile element has two slopes 18, 19 facing each other and cooperating, in the boot-fitted position, with a stop consisting of a cross member 20 integral with the arms; these two slopes constitute a U-shaped slot in which cross member 20 slides.

A hairpin spring 21 urges mobile element 16 in the direction of arrow F (in an anti-clockwise direction).

In the boot-fitted position, mobile element 16 bears against a stop 22 integral with body 8.

The retaining element bears against the rear end of the sole of boot 27, through a jaw consisting of a biconical roller 23.

Member 24 of this roller slides in a slot 25 in body 8; in the boot-fitted position, the rear end of the roller bears against a substantially cylindrical slope located on the mobile element.

A description will now be given of the operation of the heel-piece according to the invention.

Under the action of an abnormally high vertical load, the skier's heel lifts, carrying along heel-piece 7 which tends to rock forwardly in the direction of arrow G; during this movement, mobile element 16 is unable to pivot in relation to body 8, since it is bearing not only against stop 22, which is integral with body 8, but also against the rear end of roller 23, through slope 26.

Furthermore, slope 18, also known as the mobile-element release slope, is bearing against cross member 20. This prevents body 8 from rocking forwardly in the direction of arrow G, and the body therefore lifts against the action of the resilient element, thus compressing locking spring 10.

In the event of an abnormally high vertical load, the binding according to the invention therefore operates in a manner similar to the binding described in the above referred application Ser. No. 541,131, which should be referred to for any additional information.

A description will now be given of the operation of the binding when the skier voluntarily removes a ski.

In order to remove a ski, the skier rocks the heel-piece rearwardly in the direction of arrow H. During this movement, axis of rotation 17 of the mobile element travels, in relation to axis 6, on a substantially circular path in a clockwise direction.

Thus mobile element 16, which is held by cross member 20, will turn in an anti-clockwise direction in relation to body 8, and slope 26 of the mobile element will tend to push jaw-roller 23 forwardly.

Since this is impossible because the roller is bearing against the boot, the body will move back in relation to the roller. In order to move back, body 8 must compress spring 10 by an amount which is a function of the height of slope 26.

This device prevents inadvertent removal of the ski resulting, for example, from a light blow on catch 15 since, as has already been seen, the resilient element must be compressed in order to rock the heel-piece rearwardly. The load required to release the heel-piece voluntarily is at all times less than that required to effect a safety release, which facilitates the use of the binding during the practice of skiing. The difference in the two loads is substantially proportional to the difference between the length of slot 9 and the height of slope 26.

When body 8 has pivoted rearwardly to a sufficient extent, mobile element 16 rocks into a position such that cross member 20 is released from slopes 18, 19; this makes it possible for body 8 to pivot freely in the rearward direction, thus releasing the boot. It will be observed that hairpin spring 21, which urges mobile element 16 in an anti-clockwise direction, could facilitate intentional removal of the ski; the action of this spring, however, is negligible as compared with that of spring 10 which has to be compressed, as already indicated. In the boot-removed position, the heel-piece assumes a position which will be described hereinafter with reference to FIG. 2.

A description will now be given of the operation of the heel-piece when the boot is removed from the heel-piece without opening it, namely in the event of a torque bringing about the release of the front stop. As will be seen, the heel-piece, in the absence of the boot, rocks by itself into the boot-removed position since, when the boot advances in the direction of arrow M, slope 26 on the mobile element pushes roller 23 forwardly, in view of the fact that the mobile element pivots, under influence of hairpin spring 21, in the direction of arrow F.

The length of slot 25 is greater than the travel due to slope 26; it is therefore possible for mobile element 16 to escape from roller 23 and pivot about axis 17, thus releasing itself from cross member 20. This makes it possible for body 8 also to rock freely towards the rear under its own weight, in order to assume the position shown in FIG. 2. The heel-piece is now ready to accept the boot.

Roller 23 therefore appears to act as an element sensitive to the presence of the boot since, in the absence thereof, it release the lock produced by slope 26 bearing against the rear end of the roller, thus allowing the mobile element to pivot freely in a manner such that it no longer cooperates with cross member 20.

A description will now be given of FIG. 2, which shows the heel-piece described in conjunction with FIG. 1 in the boot-removed position.

In this figure, the elements previously described bear the same reference numerals as in FIG. 1; it will be observed that, in the boot-removed position, mobile element 16, which has pivoted, in relation to body 8, in an anti-clockwise direction, bears against roller 23 through a substantially circular ramp 28; it will also be observed that slopes 18, 19 of mobile element 16 no longer cooperate with cross member 20 which is integral with links 4.

A description will now be given of the operation of the heel-piece when the skier puts on his skis.

In order to fit the skis manually, it is necessary only to pull body 8 in the direction of arrow N; this first of all compresses hairpin spring 21 when slope 18 comes up against cross member 20; then, when jaw 23 bears against the sole of boot 27, locking spring 10 is compressed slightly, until the point of support of jaw-roller 23 on the sole of the boot passes below the plane containing axes 5, 6.

The heel-piece then occupies the boot-fitted position previously described in connection with FIG. 1.

It will be observed that, in the absence of the boot, only the hairpin spring is compressed; thus when the pull is no longer applied to body 8, the body falls rearwardly.

Figure 3:
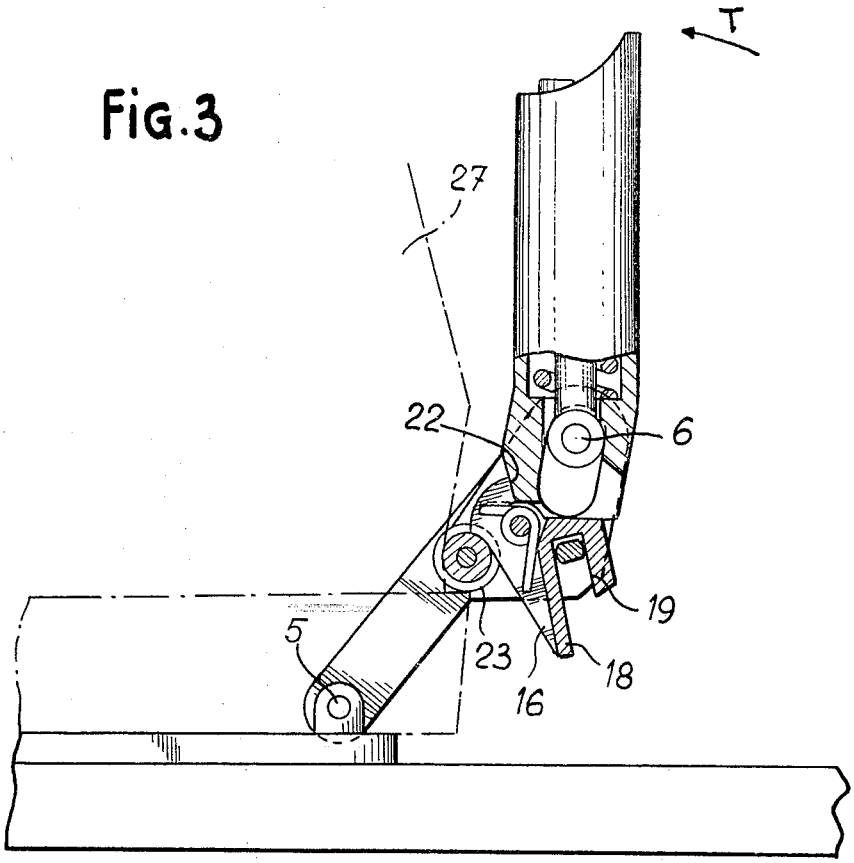
FIG. 3 is a longitudinal section through another example of embodiment of a heel-piece according to the invention, in the boot-fitted position.

A description will now be given of another example of embodiment of the invention, with reference to FIG. 3.

This figure contains most of the elements described in connection with FIG. 1, and they carry the same reference numerals.

In this example, the point of support of jaw-roller 23 on the rear end of the sole of boot 27 is located above the plane passing through axes 5,6.

In this case, slope 18 is designed to prevent overlocking of the heel-piece as a result of an inadvertent blow in the direction of arrow T, and the release slope is slope 19 which faces slope 18.

U.S. application Ser. No. 541,131 describes the operation of this system of slopes under the action of an abnormally high vertical load or an inadvertent blow.

The operation of mobile element 16, when the skis are being fitted or removed, and when the boot leaves the heel-piece without having opened it, is completely identical with that described in connection with FIGS. 1 and 2.

It will be observed, however, that in this example of embodiment stop 22 is required to prevent overlocking of the heel-piece, i.e. to prevent the point of support of the jaw-roller on the sole of the boot from being located below the plane passing through axes 5,6.

Figure 4:
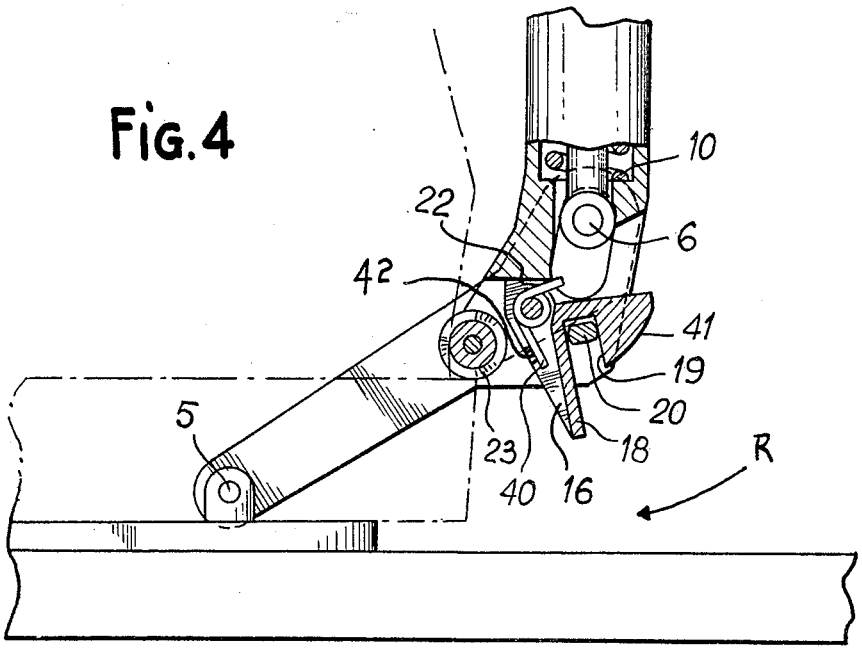
FIG. 4 is a longitudinal section through still another example of embodiment of a heel-piece according to the invention, in the boot-fitted position.

A description will now be given of FIG. 4 which illustrates still another example of embodiment of a heel-piece according to the invention.

This figure contains most of the elements described in connection with FIGS. 1 and 2, and they carry the same reference numerals.

In this example, the point of support of jaw-roller 23 on the sole of the boot is located below the plane passing through axes 5,6.

Figure 2:
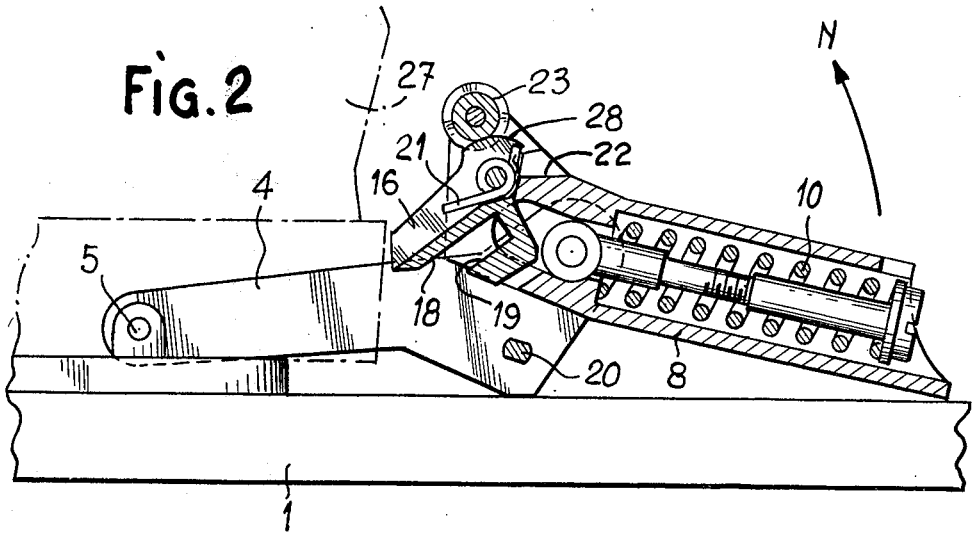
FIG. 2 is a longitudinal section through the heelpiece shown in FIG. 1, in the boot-removed position.

In this respect, the binding is of the same type as that illustrated in FIGS. 1 and 2.

It will be observed, however, that in this case the heel-piece has neither an element sensitive to the presence of the boot, nor any lock controlled by that element; thus when the boot leaves the heel-piece without having opened it, the heel-piece does not open of itself.

Moreover, it is emphasized that in this example of embodiment, the resilient system opposing the rotation of mobile element 16 from the operative position (as shown in the figure) to the inoperative, boot-removed position, consists of a hairpin spring 40 causing the mobile element to move in the direction of arrow R.

In other words, in this example of embodiment, the resilient system opposing inadvertent removal of the ski is not the resilient element 10 of the heel-piece, but an independent spring 40. It will also be observed that, in this case, slope 19, which prevents inadvertent removal of the ski by causing mobile element 16 to pivot against the action of spring 40, is extended by a slope 41 upon which cross member 20 slides when body 8 rocks towards the rear.

In the boot-removed position, regardless of whether the removal was intentional or accidental, resilient element 10 is relaxed. In order to put his skis on again, the skier rocks the heel-piece towards the front; during this movement, cross member 20 slides along slope 41 and actuates mobile element 16, thus compressing spring 40. As soon as cross member 20 engages in the U-shaped slot formed by slopes 18, 19, spring 40, one leg of which bears against a stop 42, relaxes and actuates mobile element 16 which comes up against stop 22. The skier then compresses resilient element 10 slightly, causing the point of support of jaw-roller 23 on the sole of the boot to pass below the plane passing through axes 5,6. It should be noted that in all of the examples of embodiment described above, the mobile element is the one carrying the slopes, this arrangement having the advantage of allowing the binding to open automatically if the boot leaves it in the course of a lateral fall; but it is to be understood that this arrangement is not restrictive, and that the cross member could be the mobile element. In this case it would preferably be mobile in travel in relation to the links, and it would move against the action of an independent resilient element in the U formed by the slopes which are now stationary on the body.

What I claim is:

1. A safety binding for holding one end of a boot on a ski, comprising: a pair of lateral arms each mounted at one end thereof for pivotal movement with respect to the ski; a retaining element pivotally mounted at the other end of said lateral arms and including a boot holding jaw and a resilient element; guide means operatively located between said lateral arms and said retaining element for guiding the trajectory of said jaw relative to said lateral arms when said jaw is urged by the boot against said resilient element, said guide means including an element mobile with respect to one of the following two elements: the lateral arms and the retaining element; and a manual operating means for actuating said mobile element against the action of a resilient means whereby, when said guide means are located between said lateral arms and said retaining element, the trajectory of said jaw is always substantially the same, and, when said mobile element is actuated by said manual operating means, said retaining element is free to pivot with respect to said lateral arms, and the skier may release his boot from the binding.

2. A safety binding according to claim 1, said mobile element being hingedly mounted to said retaining element.

3. A safety binding according to claim 2, wherein said guide means comprises stops and slopes; said slopes being located on said mobile element and said stops being located on said lateral arms.

4. A safety binding according to claim 3, said manual operating means are located at the upper part of said retaining element.

5. A safety binding according to claim 4, said resilient means is said resilient element.

6. A safety binding according to claim 4, furthermore intended to open automatically in the absence of the boot, said jaw comprising a roller moving in a slot provided in said retaining element.

7. A safety binding according to claim 6, said mobile element further comprising a slope bearing against a rear end portion of said roller in a boot-fitted position.

8. A safety binding according to claim 7, said mobile element being actuated by a spring means.

9. A safety binding according to claim 8, wherein the length of said slot in said retaining element is greater than the height of the slope on said mobile element whereby, in the absence of the boot, said roller may leave the slope completely and said mobile element may rock under the action of said spring means.

10. A safety binding according to claim 1, furthermore intended to open automatically in the absence of the boot, said mobile element being movable through a lock controlled by a means sensitive to the presence of the boot whereby, in the absence of the boot, said mobile element is free to move while said retaining element is free to pivot.

* * * * *